US010588415B2

(12) United States Patent
Carey

(10) Patent No.: US 10,588,415 B2
(45) Date of Patent: Mar. 17, 2020

(54) SEATING DEVICE AND METHOD OF USE

(71) Applicant: Reactive Training, LLC, San Diego, CA (US)

(72) Inventor: Anthony Carey, San Diego, CA (US)

(73) Assignee: Reactive Training, LLC, San Diego, CA (US)

( * ) Notice: Subject to any disclaimer, the term of this patent is extended or adjusted under 35 U.S.C. 154(b) by 0 days.

(21) Appl. No.: 16/136,907

(22) Filed: Sep. 20, 2018

(65) Prior Publication Data

US 2019/0104851 A1 Apr. 11, 2019

Related U.S. Application Data

(60) Provisional application No. 62/571,122, filed on Oct. 11, 2017.

(51) Int. Cl.
*A47C 7/14* (2006.01)
*A47C 7/02* (2006.01)

(52) U.S. Cl.
CPC ..... *A47C 7/021* (2013.01); *A47C 7/14* (2013.01); *A47C 7/144* (2018.08)

(58) Field of Classification Search
CPC ..... A47C 7/021; A47C 7/144
USPC ..... 297/452.21
See application file for complete search history.

(56) References Cited

U.S. PATENT DOCUMENTS 4,659,053 A * 4/1987 Holley ..... F16M 11/14 248/133
4,974,904 A * 12/1990 Phillips ..... A47C 9/002 297/258.1
5,427,426 A * 6/1995 Grappo ..... B60N 2/14 297/212
5,590,930 A * 1/1997 Glockl ..... A47C 3/0257 297/258.1
7,008,359 B2 3/2006 Fan et al.
7,100,983 B1 9/2006 Gant
7,374,517 B2 5/2008 Lockett
7,686,396 B2 * 3/2010 Schaaf ..... A47C 7/14 297/313

(Continued)

FOREIGN PATENT DOCUMENTS

GB 2458190 A 9/2009
WO 2013029575 A1 3/2013
WO 2016205229 A1 12/2016

OTHER PUBLICATIONS

International Search Report and Written Opinion for International application No. PCT/US2018/054975 dated Jan. 15, 2019 in 11 pages.

*Primary Examiner* — Mark R Wendell
(74) *Attorney, Agent, or Firm* — Procopio Cory Hargreaves and Savitch LLP

(57) ABSTRACT

A method of using a seating device including a base, a plurality of roller mechanisms, a seat operably associated with the base via the plurality of roller mechanisms for movement relative thereto, the seat including a leading edge in a direction of travel, comprises receiving a user's sitting area on the seat of the seating device with the seat in a position centered over the base; and based on user input the seat moving toward the leading edge in the direction of travel away from the seat centered over the base while the user's muscles are engaged to maintain an upright posture, helping to improve the user's motor control, stability and strength over time.

18 Claims, 6 Drawing Sheets

(56) References Cited

U.S. PATENT DOCUMENTS

| | | | | |
|---|---|---|---|---|
| 8,919,881 | B2 * | 12/2014 | Bay | A47C 7/402 297/311 |
| 8,926,483 | B1 * | 1/2015 | Holloway | A63B 26/003 297/271.5 |
| 8,967,716 | B2 * | 3/2015 | Mountz | A47C 9/02 297/256.12 |
| 9,398,811 | B1 * | 7/2016 | Williams | A47C 3/12 |
| 9,788,659 | B1 * | 10/2017 | Jen | A47C 9/002 |
| 9,924,798 | B2 * | 3/2018 | Broerman | A47C 9/002 |
| 2005/0173952 | A1 * | 8/2005 | Van Der Laan | A47C 15/004 297/217.3 |
| 2006/0097555 | A1 | 5/2006 | Meleger | |
| 2007/0155603 | A1 | 7/2007 | Cook | |
| 2007/0252419 | A1 | 11/2007 | Takahashi | |
| 2011/0028290 | A1 * | 2/2011 | Ozawa | A63B 21/0085 482/142 |
| 2011/0089733 | A1 | 4/2011 | Nishino | |
| 2013/0116100 | A1 | 5/2013 | Chen | |
| 2014/0162852 | A1 | 6/2014 | Ho et al. | |
| 2014/0162859 | A1 | 6/2014 | Cheng | |
| 2014/0265495 | A1 * | 9/2014 | Bay | A47C 7/402 297/311 |
| 2017/0021230 | A1 | 1/2017 | Osler et al. | |

* cited by examiner

SEATING DEVICE AND METHOD OF USE

FIELD OF THE INVENTION

The present invention relates to seating devices and methods of use.

BACKGROUND

Health costs associated with prolonged sitting include both musculoskeletal injury (lower back pain, neck/shoulder pain) and a high correlation with cardiovascular disease. However, sitting will never go away completely.

A recognition of the present invention is that if people are going to sit, an environment should be created that makes sitting productive and not a consequence of doing focused work.

SUMMARY OF THE INVENTION

Aspects of the invention involve a seating device and method of use with a movable base of support that allows for a controlled, dynamic sitting experience providing benefits to the pelvic floor, lower back, hips, and abdominals. The user concurrently trains one's trunk muscles and stabilization of orientation of the head and neck over this moving base of support. Additionally, the numerous combinations of motion acting on the hips, pelvis and lower back help to distribute musculoskeletal stress away from any specific region while maintaining continual blood flow circulation to those areas.

Another aspect of the invention involves a method of using a seating device including a base, a plurality of roller mechanisms, a seat operably associated with the base via the plurality of roller mechanisms for movement relative thereto, the seat including a leading edge in a direction of travel. The method comprises receiving a user's sitting area on the seat of the seating device with the seat in a position centered over the base; and based on user input the seat moving toward the leading edge in the direction of travel away from the seat centered over the base while the user's muscles are engaged to maintain an upright posture, helping to improve the user's motor control, stability and strength over time.

One or more implementations of the aspect of the invention described immediately above includes one or more of the following: the base includes a convex upper surface and the seat includes a convex upper surface and a concave lower surface that is operably associated with the convex upper surface of the base via the plurality of roller mechanisms for movement relative thereto, receiving a user's sitting area includes receiving a user's sitting area on the convex upper surface of the seat, and the seat moving includes the seat moving toward the leading edge in the direction of travel away from the seat centered over the base so that the leading edge of the seat dips in the direction of travel; one's muscles of the hips, lower back, abdominals and pelvic floor are engaged to decelerate motion of the seat as gravity acts on a user's center of gravity; the base includes a convex upper surface and the seat includes a concave upper surface and a convex lower surface that is operably associated with the convex upper surface of the base via the plurality of roller mechanisms for movement relative thereto, receiving a user's sitting area includes receiving a user's sitting area on the concave upper surface of the seat, and the seat moving includes the seat moving toward the leading edge in the direction of travel away from the seat centered over the base so that the leading edge of the seat rises in the direction of travel; the seating device includes a restrictor mechanism limiting motion of the seat relative to the base, and the seat moving includes restricting the amount of travel of the seat relative to the base with the restrictor mechanism; the restrictor mechanism includes a restrictor shaft and a restrictor plate, and the seat moving includes restricting the amount of travel of the seat relative to the base with the restrictor shaft and the restrictor plate of the restrictor mechanism; the base has a convex upper surface, the seat has a lower surface, and the plurality of roller mechanisms include three evenly spaced ball transfers disposed in the base, and the seat moving includes the ball transfers maintaining continual contact with the lower surface of the seat; the seat has a concave lower surface and the three evenly spaced ball transfers are disposed and spaced in the base so that the seat maintains continual contact with the seat regardless of whether the seat is oriented concave down or concave up relative to the base; orienting the seat concave up relative to the based so that the convex upper surface is in contact with the ball transfers; the base includes a flat bottom plate, and the method further comprising distributing weight of the user across a broad area with the flat bottom plate; the seating device is integrated into a sitting apparatus; the seat moving causes the seat to tilt, slide, and rotate 360 degrees relative to the base; and/or the seat includes an upper surface that is one of flat, convex, and concave.

DETAILED DESCRIPTION

Figure 1:
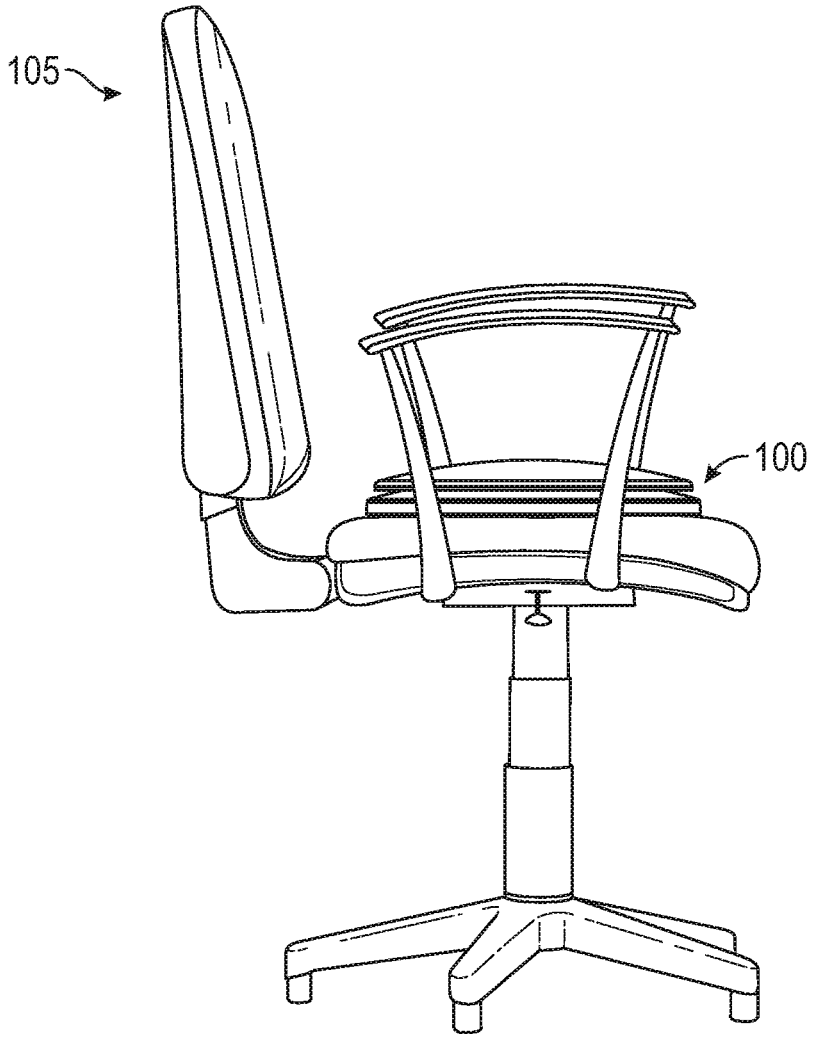
FIG. 1 is a perspective view of an embodiment of a seating device shown on an office chair.
Figure 2:
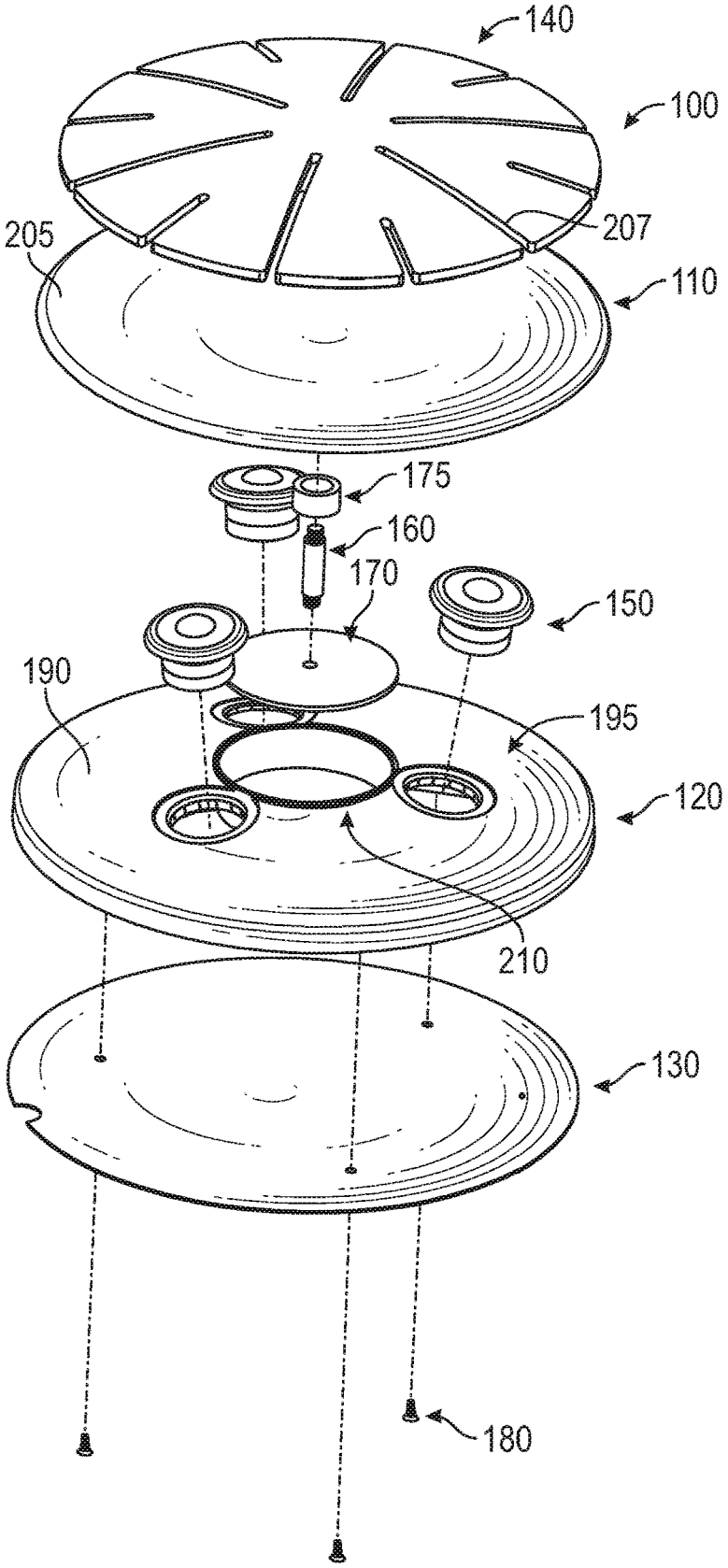
FIG. 2 is an exploded perspective view of the seating device.
Figure 3:
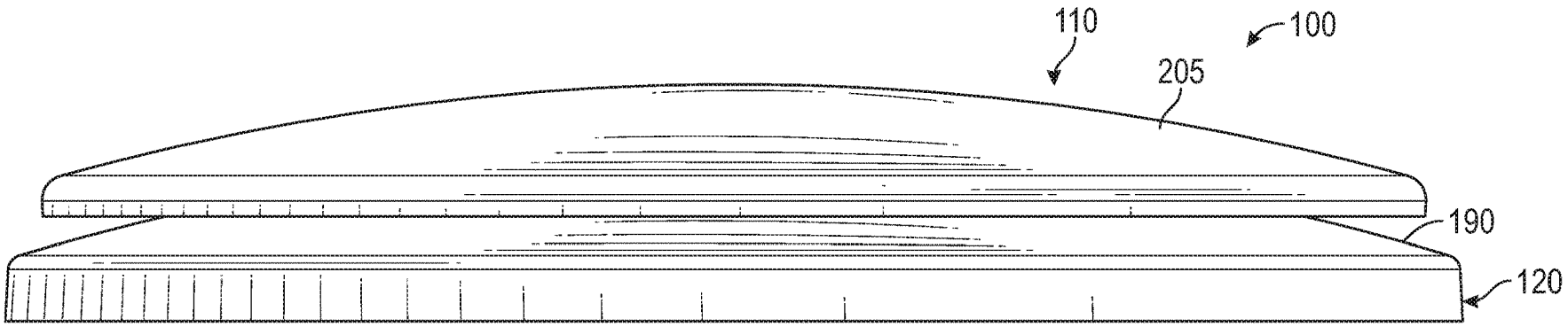
FIG. 3 is a side elevational view of the seating device with the seat shown centered over the housing.

With reference initially to FIGS. 1-6, an embodiment of a seating device 100 and method of use with a movable base of support that allows for a controlled, dynamic sitting experience providing benefits to the pelvic floor, lower back, hips, abdominals will be described. The seating device 100 can be easily picked up and placed on another support surface (e.g., standard chair seats, benches, airplane seats, couches, recliners, floors) such as any chair 105. Alternatively, the seating device 100 is constructed/integrated into the chair 105 such that it becomes a permanent part of the entire sitting apparatus. In such an embodiment, a base 120 of the seating device 100 is part of the internal framework of the chair and the available sitting surface for the chair is a seat 110 of the seating device 100.

The embodiment of the seating device 100 that can be easily picked up and placed on any chair 105 and shown in FIGS. 1-6 includes a seat ("seat") 110, a base ("base") 120, a bottom plate 130, a foam topper 140, three or more roller mechanisms (e.g., ball transfers) 150, a restrictor shaft 160, a restrictor plate 170, a bumper 175, and a plurality of threaded fasteners (e.g., screws 180).

Figure 5:
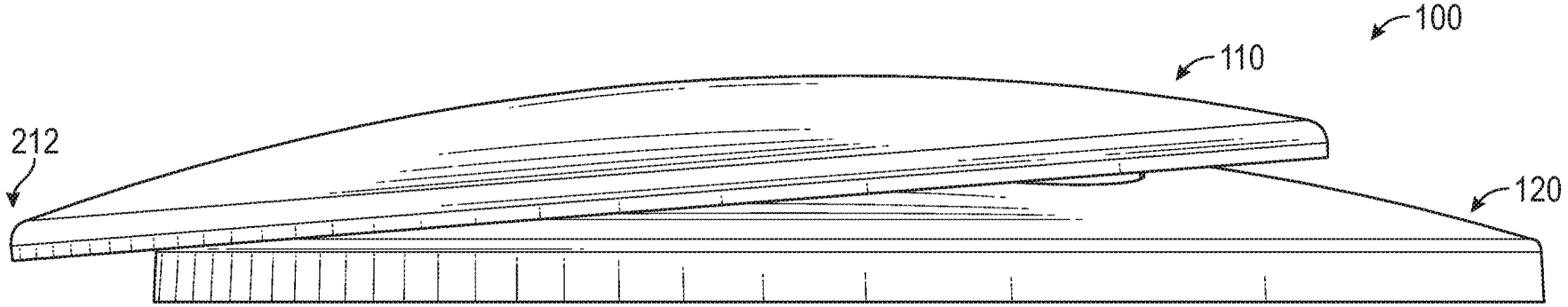
FIG. 5 is a side elevational view of the seating device with the seat shown off-centered relative to the housing.
Figure 6:
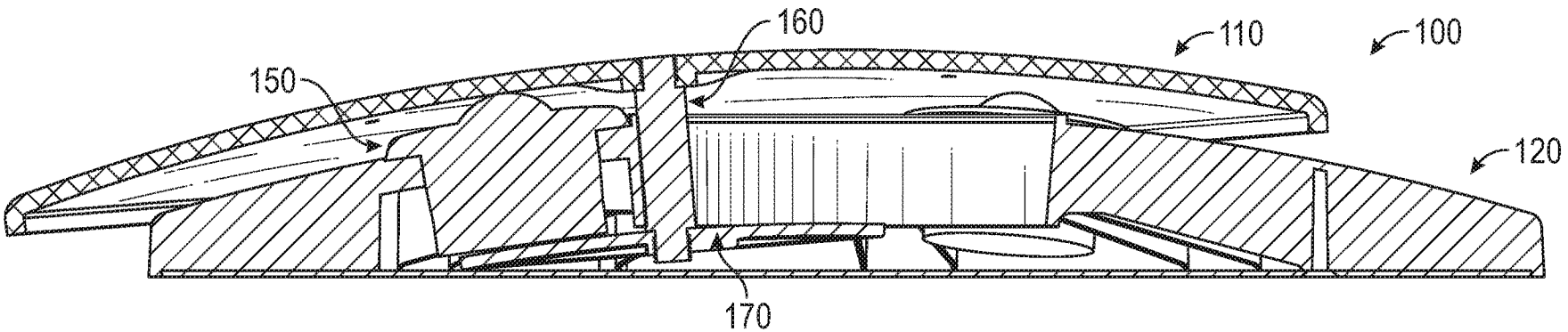
FIG. 6 is a cross-sectional view of the seating device of FIG. 5.
Figure 7:
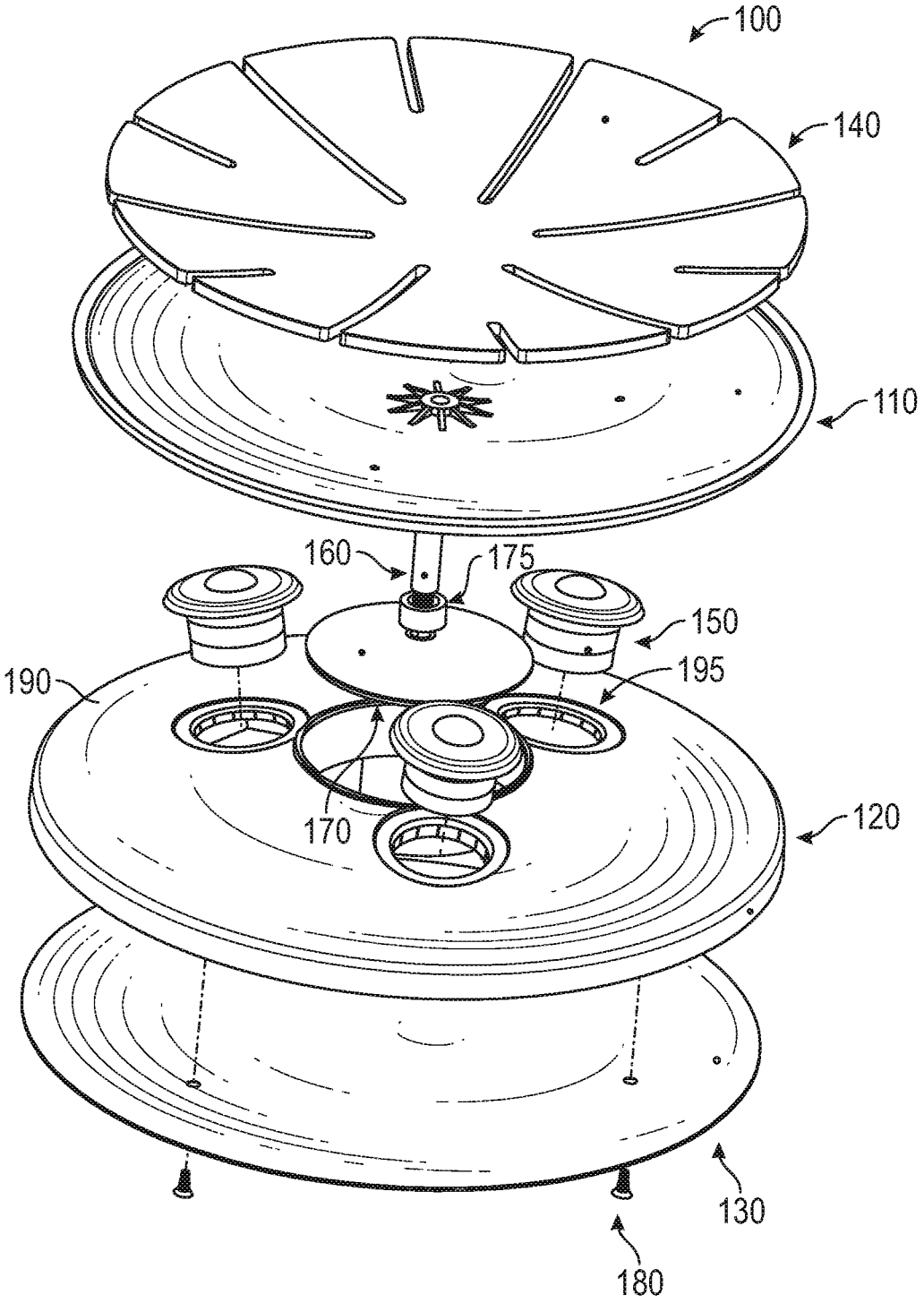
FIG. 7 is an exploded perspective view of another embodiment of the seating device.
Figure 8:
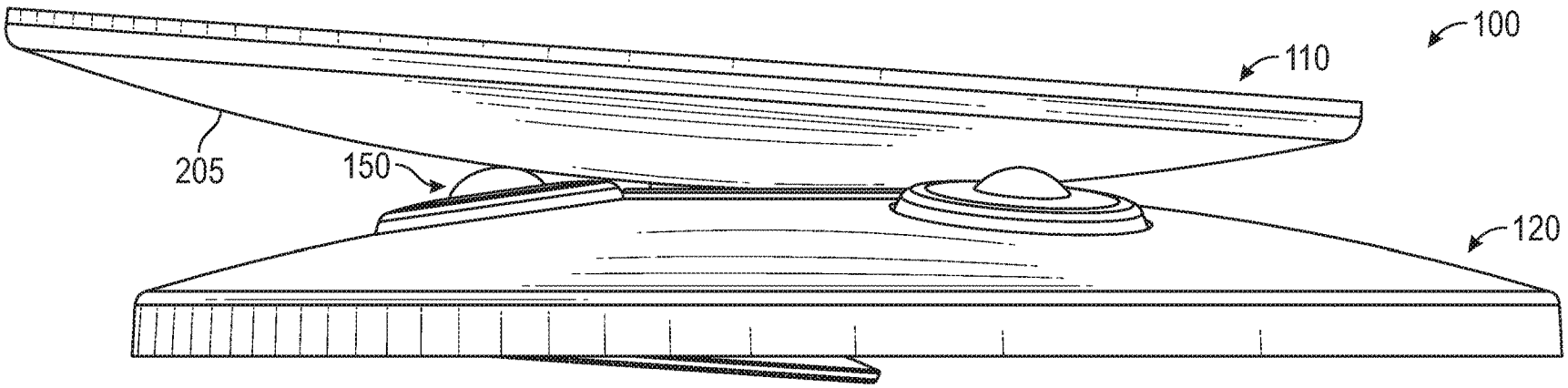
FIG. 8 is a side elevational view of the seating device of FIG. 7 with the seat shown off-centered relative to the housing.
Figure 9:
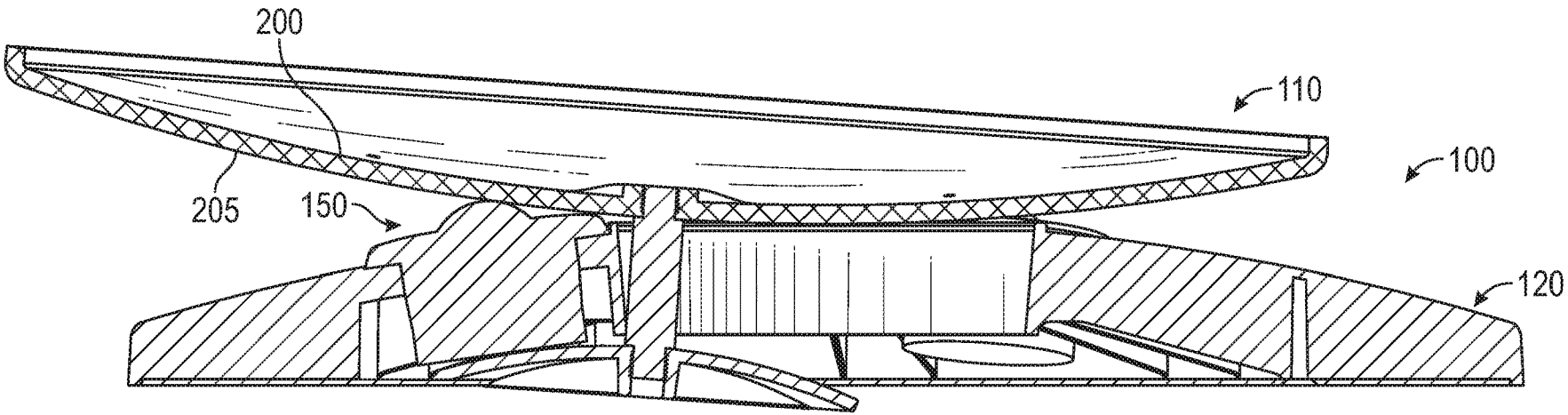
FIG. 9 is a cross-sectional view of the seating device of FIG. 8.

The base 120 has an convex upper surface 190 that contains three ball transfers 150 in receiving holes 195 that are oriented upwardly and outwardly and match the tangent (s) of the upper surface 190 when the seat 110 is in both in the concave down orientation, as shown in FIGS. 1-6, and in the concave up orientation, as shown in FIGS. 7-9. The flat bottom plate 130 of the base 120 allows it to distribute the weight of the user across a broad area without compressing the padding of the underlying chair 105, as the seat 110 tilts, slides, and rotates 360 degrees unrestricted relative the base 120 during use.

Figure 4:
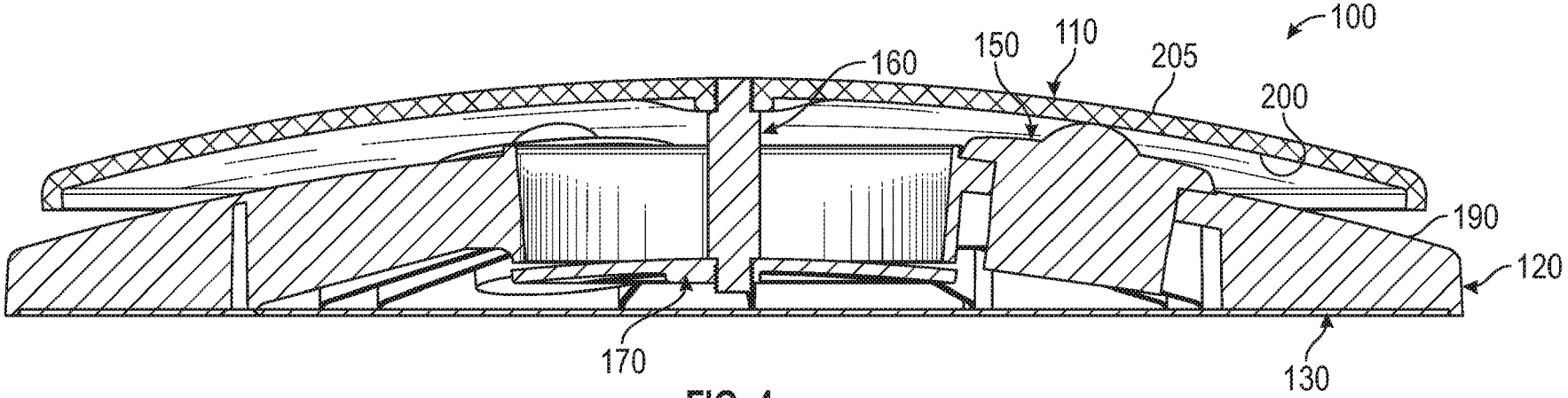
FIG. 4 is a cross-sectional view of the seating device of FIG. 3.

As shown in FIG. 4, the seat 110 is bowl-shaped and is provided convex surface up/concave surface down. The seat 110 includes a concave lower surface 200 that sits in direct contact with the ball transfers 150. The ball transfers include receptacles that face outwardly from center in the base 120. The ball transfers 150 are placed equal distance from one another to maintain continual contact during its interface with the seat 110 of the seating device 100. The orientation and spacing of the ball transfers 150 on the base 120 allows the seat 110 to operate either concave down or concave up relative to the base 120. The radius of curvature of the concave lower surface 200 of the seat 110 is the same as the radius of the curvature of the convex upper surface 190 of the base 120. The convex surface up creates an outward pressure on the ishial tuberosities of the pelvis. This can influence the muscles of the pelvic floor. The user's base of support is wider creating a greater moment of inertia compared to concave surface up. This produces a slightly less responsive environment. The user's center of gravity is never greater than when the top is centered over the middle of the base. The farther the center of the sitting surface moves from the center of the base, the edge of the seat in the direction of the motion drops. This motion also produces the opposite anatomical result than the convex side orientation to the vertebral joints and soft tissue structures that attach to the spine and pelvis.

In the embodiment of FIGS. 1-6, the seat 110 has a convex upper surface 205 with the foam topper 140 thereon. The foam topper 140 has a plurality of sunburst slits 207 therein. The foam topper 140 provides a more comfortable padded surface for the user sitting on the seat 110.

The range of the seat 110 is limited by the central restrictor shaft 160 that screws into the underside of the seat 110 piece. The foam bumper 175 softens the contact with the circular opening 210 in the base 120 that limits the travel of the central restrictor shaft 160. The central restrictor shaft 160 passes through a circular opening 210 in the base 120. The diameter of the circular opening 210 serves to limit how far the seat 110 can move in relation to the bottom base 120. At the inferior end of the central restrictor shaft 160 is the circular restrictor plate 170 that keeps the central restrictor shaft 160 in place and seat 110 and bottom base 120 in continuous contact. This arrangement also prevents the seat 110 from separating from the bottom base 120.

As shown in FIGS. 5, 6, in use, when a user sits on the seat 110, as the seat 110 moves away from center in any direction, a leading edge 212 in the direction of travel will tilt downwardly and move radially outward as the seat 110 continues to slide toward its end range. In its end range, the leading edge 212 is no longer disposed vertically over the base 120, but is disposed beyond a periphery 214 of the base 120. The combination of the concave lower surface 200 of the seat 110, the convex upper surface 190 of the base 120, the circular opening 210, the circular restrictor plate 170, and the central restrictor shaft 160 allow the seat 110 to tilt, slide, and rotate relative the base 120 simultaneously as the user's center of gravity moves incorporating motion in multiple vectors and tangents concurrently.

When used with convex top/concave bottom, the seat 110 acts similarly to a saddle. As the seat 110 moves from the balanced center positon gravitational forces act on the user's center of gravity in the direction of movement and the seat 110 dips in the direction of the motion. This creates a change in position of the pelvis and lumbar spine and engages the muscles of the hips, lower back, abdominals and pelvic floor as the user works to maintain their upright posture and stabilizing their head and neck to keep the eyes level with the horizon. The muscles of the user work to decelerate the motion of the seat 110 as gravity acts on the user's center of gravity. With the user sitting on the seat 110, motion of the pelvis has the ability to move in all 3 planes of motion in any and all combinations (this is also true for when the seat 110 is concave-up). The available directional motions and responsiveness of the seat 110 produces an ongoing environment to continually create variable neuromuscular activity to the user, thus offering them a more complete and robust opportunity for motor control, stability and strength. Additionally, the numerous combinations of motion acting on the hips, pelvis and lower back help to distribute musculoskeletal stress away from any specific region while maintaining continual blood flow circulation to those areas.

With reference to FIGS. 7-9, alternatively, the seat 110 can be flipped over and used with the concave side up/convex side down, creating a convex to convex relationship with the convex upper surface 190 of the base 120. With this usage, the user would be sitting inside the convex "bowl", on the concave surface 200 of the seat 110. In use, when a user sits on the seat 110, as the seat 110 moves away from center, the seat 110 would rise up on the leading edge 212, in the direction of travel (opposite to what occurs when convex side is down as shown in FIGS. 1-6). Concave surface up cradles the hips and pelvis thereby changing the gravitational and surface reaction forces on the bones of the pelvis. The user's sitting base of support is narrower creating a smaller moment of inertia and a more rapid reaction by the user. The farther the center of the sitting surface moves from the center of the base, the more the edge of the seat in the direction of the motion raises. This motion also produces the opposite anatomical result than the concave side orientation to the vertebral joints and soft tissue structures that attach to the spine and pelvis. Additionally, during motion the user's center of gravity will be higher from the sitting surface compared to concave side down, producing greater relative motion of the lumbar segments.

In alternative embodiments, the seating device has a seat 110 that has a substantially flat upper seating surface and the underside of the seat 110 is either concave down or convex down and the base 120 is convex up as shown in FIGS. 1-6. Alternatively, if the underside of the seat 110 is convex down, in further embodiments, where upper seating surface is substantially flat, convex, or concave, the base 120 is concave up.

The motion of the seating device 100 allows for a controlled, dynamic sitting experience providing benefits to the pelvic floor, lower back, hips, abdominals. The user concurrently trains their trunk muscles and stabilization of orientation of the head and neck over this moving base of support. The seating device 100 develops strength, mobility and improved function to those suffering with urinary incontinence, lower back pain and abdominal weakness. Additionally, it may provide a productive movement outlet for both adults and children who experience difficulty sitting still such as in the case of Attention Deficit Hyperactivity Disorder (ADHD).

The seating device 100 can also be placed on the floor where it can be used for additional exercise applications. Such applications would include sitting exercises that challenge the user's body differently than on a chair because of the relationship of the knees and feet to the hips and floor. Additionally, the hands can be placed on the device while on the floor for core and shoulder exercises.

Via its mechanical design, the seating device 100 responds to any subtle shift in one's weight and requires no batteries or electricity. The sensitivity of the ball transfers 150 creates a reactive environment in which the user must consciously and unconsciously respond to positional changes of the seat using the muscles of the lumbo-pelvic-hip complex. The seat 110 of the seating device 100 tilts, slides, and rotates simultaneously as the user's center of gravity moves incorporating motion in multiple vectors and tangents concurrently. The combination of the tilt, slide and rotation create an almost infinite number of movement combinations that create continual varying input to the soft tissue, joints and nervous system.

The option of both orientations of the seat 110 allows the user to self-select a particular preference to a directional motion that meets their needs. For example, with concave surface up, motion to the right of center will cause lateral flexion of the spine to the right. Conversely, with the convex surface up, motion to the right will cause lateral flexion of the spine to the left—same direction of platform with an opposing anatomical response.

External attachments can be applied to the top of seating device 100 that are used internally by the user for therapeutic purposes and or sexual pleasure. Attachments would be vertically orientated and of varying heights and widths that meet the needs of the user.

Static sitting in a theoretical "ideal" position requires continual isometric muscular contractions to maintain the posture. This has its own associated negative consequences as the tissue becomes ischemic (decreased oxygenated blood) and the small stabilizing muscles fatigue. Static "ideal" sitting using a chair support does the opposite requiring no muscular activation and leads to decreased neural activation of the muscles and possible physiological creep (passive lengthening) of connective tissue. The seating device 100 provides a middle ground.

The controlled and variable motion of the seating device 100 provides user controlled movements of the hips and lower back and muscles of the trunk. This keeps oxygen flowing to the muscles and equally important provides ongoing variety to the stresses and strains on the tissue and joints, sparing them from the accumulated stress associated with stationary sitting.

The detrimental effects associated with slouching are minimized on the seating device 100 because once the platform reaches any one of its end ranges, the user can still benefit from the rotational aspect of the seat. It is valuable to understand the act of slouching in and of itself is not detrimental unless it provokes immediate pain. The damage done from slouching is associated with duration and is cumulative. There is a lack of noxious feedback from one's body because it is using the lowest energy expending position at that time. Gentle movements with minimal effort associated with the seating device 100 interrupts this cycle.

The responsiveness of the seating device 100 to subtle weight shifts can be either intentional or consequential. This creates a "pitch and catch" between the user and the seating device 100 that produces ongoing engagement with the seating device 100 and user until the user wants to stop. The user determines: a) at what tempo they want the seating device 100 to move; b) in what direction(s) they want the seating device 100 to move; and c) at what amplitude they want the seating device 100 to move.

While various embodiments of the present invention have been described above, it should be understood that they have been presented by way of example only, and not of limitation. Likewise, the various diagrams may depict an example architectural or other configuration for the disclosure, which is done to aid in understanding the features and functionality that can be included in the disclosure. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present disclosure.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present disclosure should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent.

I claim:

1. A method of using a seating device including a base having a convex upper surface, a plurality of roller mechanisms, a seat having a convex upper surface and a concave lower surface that is operably associated with the convex upper surface of the base via the plurality of roller mechanisms for movement relative thereto, the seat including a leading edge in a direction of travel, comprising:

receiving a user's sitting area on the convex upper surface of the seat of the seating device with the seat in a position centered over the base;

based on user input the seat moving toward the leading edge in the direction of travel away from the seat centered over the base while the user's muscles are engaged to maintain an upright posture, helping to improve the user's motor control, stability and strength over time, and whereby the leading edge of the seat dips in the direction of travel.

2. The method of using a seating device of claim 1, wherein one's muscles of the hips, lower back, abdominals and pelvic floor are engaged to decelerate motion of the seat as gravity acts on a user's center of gravity.

3. The method of using a seating device of claim 1, wherein the seating device includes a restrictor mechanism limiting motion of the seat relative to the base, and the seat moving includes restricting the amount of travel of the seat relative to the base with the restrictor mechanism.

4. The method of using a seating device of claim 3, wherein the restrictor mechanism includes a restrictor shaft and a restrictor plate, and the seat moving includes restricting the amount of travel of the seat relative to the base with the restrictor shaft and the restrictor plate of the restrictor mechanism.

5. The method of using a seating device of claim 1, wherein the plurality of roller mechanisms include three evenly spaced ball transfers disposed in the base, and the seat moving includes the ball transfers maintaining continual contact with the lower surface of the seat.

6. The method of using a seating device of claim 5, wherein the three evenly spaced ball transfers are disposed and spaced in the base so that the seat maintains continual contact with the seat regardless of whether the seat is oriented concave down or concave up relative to the base.

7. The method of using a seating device of claim 6, further including orienting the seat concave up relative to the base so that the convex upper surface is in contact with the ball transfers.

8. The method of using a seating device of claim 1, wherein the base includes a flat bottom plate, and the method further comprising distributing weight of the user across a broad area with the flat bottom plate.

9. The method of using a seating device of claim 1, wherein the seating device is integrated into a sitting apparatus.

10. The method of using a seating device of claim 1, wherein the seat moving causes the seat to tilt, slide, and rotate 360 degrees relative to the base.

11. A method of using a seating device including a base having a convex upper surface, a plurality of roller mechanisms, a seat having a convex upper surface and a concave lower surface that is operably associated with the convex upper surface of the base via the plurality of roller mechanisms for movement relative thereto, the seat including a leading edge in a direction of travel, comprising:

receiving a user's sitting area on the seat of the seating device with the seat in a position centered over the base with the seat at maximum height;

based on user input the seat moving toward the leading edge in the direction of travel away from the seat centered over the base while the user's muscles are engaged to maintain an upright posture, helping to improve the user's motor control, stability and strength over time, and whereby no portion of the seat is above the maximum height.

12. The method of using a seating device of claim 11, wherein the seat includes a seating pad having a sunburst pattern, and receiving a user's sitting area includes receiving the user's sitting area on the seating pad having the sunburst pattern with radiating slits.

13. The method of using a seating device of claim 11, wherein plurality of roller mechanisms are oriented at angles other than 0 degrees relative to horizontal on the convex upper surface of the base.

14. The method of using a seating device of claim 11, further including orienting the seat concave up relative to the base so that the convex upper surface is in contact with the ball transfers.

15. A method of using a seating device including a base having a convex upper surface, a plurality of roller mechanisms, a seat having a convex upper surface and a concave lower surface that is operably associated with and free floating with respect to the convex upper surface of the base via the plurality of roller mechanisms for movement relative thereto, the seat including a leading edge in a direction of travel, comprising:

receiving a user's sitting area on the convex upper surface of the seat of the seating device with the seat in a position centered over the base;

based on user input the seat moving toward the leading edge in the direction of travel away from the seat centered over the base while the user's muscles are engaged to maintain an upright posture, helping to improve the user's motor control, stability and strength over time, and whereby the seat is free floating with respect to the convex upper surface of the base and within the seating device.

16. The method of using a seating device of claim 15, wherein the seat includes a seating pad having a sunburst pattern, and receiving a user's sitting area includes receiving the user's sitting area on the seating pad having the sunburst pattern with radiating slits.

17. The method of using a seating device of claim 15, wherein plurality of roller mechanisms are oriented at angles other than 0 degrees relative to horizontal on the convex upper surface of the base.

18. The method of using a seating device of claim 15, further including orienting the seat concave up relative to the base so that the convex upper surface is in contact with the ball transfers.

* * * * *